US008725044B2

(12) United States Patent
Nose et al.

(10) Patent No.: US 8,725,044 B2
(45) Date of Patent: May 13, 2014

(54) DEVELOPING DEVICE

(75) Inventors: Katsuya Nose, Matsudo (JP); Akihiro Noguchi, Toride (JP); Asuna Fukamachi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 127 days.

(21) Appl. No.: 13/348,854

(22) Filed: Jan. 12, 2012

(65) Prior Publication Data

US 2012/0195647 A1 Aug. 2, 2012

(30) Foreign Application Priority Data

Jan. 28, 2011 (JP) ..... 2011-016179

(51) Int. Cl.
*G03G 15/09* (2006.01)

(52) U.S. Cl.
USPC ..... 399/269; 399/279

(58) Field of Classification Search
USPC ..... 399/267, 269, 279, 282, 284, 276, 286
See application file for complete search history.

(56) References Cited

U.S. PATENT DOCUMENTS

| | | | | |
|---|---|---|---|---|
| 5,286,917 | A | 2/1994 | Unno et al. | |
| 6,681,092 | B2 | 1/2004 | Terai | |
| 6,978,108 | B2 | 12/2005 | Sakamaki | |
| 7,054,583 | B2 * | 5/2006 | Hirobe | 399/269 |
| 7,263,318 | B2 | 8/2007 | Nishihama et al. | |
| 7,277,649 | B2 | 10/2007 | Hirobe et al. | |
| 7,349,653 | B2 | 3/2008 | Nishihama et al. | |
| 7,362,989 | B2 | 4/2008 | Nishihama et al. | |
| 7,386,261 | B2 | 6/2008 | Noguchi et al. | |
| 7,389,073 | B2 | 6/2008 | Kumar et al. | |
| 7,430,389 | B2 | 9/2008 | Noguchi et al. | |
| 7,596,345 | B2 | 9/2009 | Hirobe et al. | |
| 7,630,670 | B2 | 12/2009 | Nishihama et al. | |
| 7,664,435 | B2 | 2/2010 | Nose | |
| 7,826,772 | B2 | 11/2010 | Hirobe et al. | |
| 7,881,638 | B2 | 2/2011 | Noguchi et al. | |
| 8,064,796 | B2 | 11/2011 | Mitsumori et al. | |
| 8,107,863 | B2 | 1/2012 | Yamazaki et al. | |
| 8,211,602 | B2 | 7/2012 | Mitsumori et al. | |

(Continued)

FOREIGN PATENT DOCUMENTS

| | | | |
|---|---|---|---|
| CN | 1062606 | A | 7/1992 |
| CN | 101046655 | A | 10/2007 |

(Continued)

OTHER PUBLICATIONS

Notification of the First Office Action dated May 27, 2013, in Chinese Application No. 201210020056.4.

(Continued)

*Primary Examiner* — David Gray
*Assistant Examiner* — Carla Therrien
(74) *Attorney, Agent, or Firm* — Fitzpatrick, Cella, Harper & Scinto

(57) ABSTRACT

A developing device includes a developing container unit configured to contain and circulate a developer, and a plurality of developer carrying members each for carrying on its surface the developer for developing an electrostatic latent image on an image bearing member. The developer carrying member providing a largest difference in driving torque measured before and after being coated with a toner on its surface thereof is provided with a plurality of circumferentially spaced grooves, and the remaining developer carrying member has a blast-treated surface.

3 Claims, 4 Drawing Sheets

(56) References Cited

U.S. PATENT DOCUMENTS

| | | | | |
|---|---|---|---|---|
| 8,221,950 | B2 | 7/2012 | Mitsumori et al. | |
| 2003/0170050 | A1 | 9/2003 | Terai | |
| 2003/0235437 | A1 | 12/2003 | Sakamaki | |
| 2007/0231018 | A1 | 10/2007 | Kumar et al. | |
| 2008/0292367 | A1 | 11/2008 | Yamazaki et al. | |
| 2009/0041500 | A1 | 2/2009 | Mitsumori et al. | |
| 2009/0053634 | A1 | 2/2009 | Mitsumori et al. | |
| 2009/0180807 | A1 | 7/2009 | Mitsumori et al. | |
| 2009/0291379 | A1 | 11/2009 | Oota et al. | |
| 2010/0316411 | A1 | 12/2010 | Mitsumori et al. | |
| 2010/0316412 | A1 | 12/2010 | Mitsumori et al. | |
| 2011/0052220 | A1 | 3/2011 | Nose | |
| 2011/0129262 | A1 * | 6/2011 | Nakamoto | 399/286 |
| 2011/0200356 | A1 | 8/2011 | Watanabe et al. | |
| 2012/0039630 | A1 | 2/2012 | Mitsumori et al. | |
| 2012/0045236 | A1 | 2/2012 | Fukamachi | |
| 2012/0045246 | A1 | 2/2012 | Mitsumori et al. | |
| 2013/0059250 | A1 | 3/2013 | Mitsumori et al. | |
| 2013/0143156 | A1 | 6/2013 | Mitsumori et al. | |

FOREIGN PATENT DOCUMENTS

| | | | |
|---|---|---|---|
| CN | 101410763 | A | 4/2009 |
| CN | 101627342 | A | 1/2010 |
| JP | 2002-351208 | A | 12/2002 |
| JP | 2003-295599 | A | 10/2003 |
| JP | 2004-21125 | A | 1/2004 |
| JP | 2004-163906 | A | 6/2004 |
| JP | 2007-171403 | A | 7/2007 |
| JP | 2008-145774 | A | 6/2008 |
| WO | 2011/158785 | A1 | 12/2011 |

OTHER PUBLICATIONS

Combined Search and Examination Report Under Sections 17 and 18(3), dated May 23, 2012, in Great Britain Application No. GB1201320.7.

* cited by examiner (a)

(b)

| PARAMETER | EXP(1) | EXP(2) | EXP(3) | EXP(4) |
|---|---|---|---|---|
| UP-SLEEVE | BLAST | GROOVE | GROOVE | BLAST |
| LW-SLEEVE | BLAST | GROOVE | BLAST | GROOVE |
| UP-TORQUE(N · m) | 0.7 | 0.7 | 0.7 | 0.7 |
| LW-TORQUE(N · m) | 0.4 | 0.4 | 0.4 | 0.4 |
| FIRST ABRADED | UPPER | UPPER | LOWER | UPPER |
| IDLING TIME(hour) | 250 | 750 | 500 | 250 |
| PITCH NON-UNIFORMITY | ○ | × | ○ | ○ |

| PARAMETER | EXP(5) | EXP(6) | EXP(7) | EXP(8) |
|---|---|---|---|---|
| UP-SLEEVE | BLAST | GROOVE | GROOVE | BLAST |
| LW-SLEEVE | BLAST | GROOVE | BLAST | GROOVE |
| UP-TORQUE(N・m) | 0.6 | 0.6 | 0.6 | 0.6 |
| LW-TORQUE(N・m) | 0.8 | 0.8 | 0.8 | 0.8 |
| FIRST ABRADED | LOWER | LOWER | LOWER | UPPER |
| IDLING TIME(hour) | 250 | 750 | 250 | 400 |
| PITCH NON-UNIFORMITY | ○ | × | ○ | ○ |

DEVELOPING DEVICE

FIELD OF THE INVENTION AND RELATED ART

The present invention relates to a developing device for use with an image forming apparatus such as an electrophotographic copying machine or a laser beam printer.

As the developing device used in a conventional image forming apparatus, there is a magnetic brush developing device of a two-component developing type using a developing sleeve. In such a developing device, in order to meet a demand for speed-up of the copying machine, by using a multi-stage magnetic brush developing method as described in Japanese Laid-Open Patent Application (JP-A) 2004-21125, a peripheral speed of the developing device and the developing sleeve is increased. In the multi-stage magnetic brush developing method, even when the peripheral speed of the developing device and the developing sleeve is increased, development can be effected by a portion developing sleeve and therefore a necessary developing time can be ensured, so that suitable image formation can be effected.

Further, in recent years, further lifetime extension of the developing device has been required. The cause of the lifetime of the developing device is abrasion (wearing) with time of the developing sleeve surface where a two-component developer is carried and conveyed. Ordinarily, the developing sleeve surface is subjected to blasting to create moderate projections and recesses and by these projections and recesses, a conveying (feeding) force of the developer is increased, so that a developer conveyance amount is ensured. However, in the blasting, a portion where a height of the projections is large is liable to be strongly subjected to the abrasion by friction with the developer and thus an amount of the projections and recesses is decreased by durability of image formation, so that the conveyance amount of the developer is lowered and thus the lifetime of the developing device is ended.

Therefore, as described in JP-A 2003-295599, a countermeasure in which the developing sleeve surface is subjected to processing (treatment) such that a portion grooves including a component extending along a long-axis direction are arranged in parallel at a predetermined interval (i.e., grooving procession (treatment)) and in addition, a depth, width and interval of these grooves are controlled to keep the developer conveyance amount at a constant level with time has been proposed. Specifically, the depth of the grooves at the developing sleeve surface is made a depth (about 50-150 μm) which is considerably larger than a depth (about 5-15 μm) of minute projections and recesses by ordinary blasting and in addition, a degree of a variation in depth of the grooves is made small. As a result, the degree of the abrasion by the friction with the developer becomes uniform and in addition, the groove depth is larger than the depth of the projections and recesses by the blasting and therefore it is possible to realize a long-life developing sleeve which is small in change of a developer conveying property due to the abrasion and is stable with time.

However, in a technique described in JP-A 2003-295599, by a period (cycle) of the grooves processed at the surface of the portion developing sleeves, a formed image is liable to cause density non-uniformity.

Particularly, in the case where a so-called spherical toner or a toner with a high surface smoothness, which is produced by a polymerization method or the like so as to meet a demand for image quality improvement and definition improvement in recent years, a dependency of the developer conveyance amount on a developing sleeve surface state is high. For this reason, an amount of the developer conveyed at a recessed portion of the grooves of the developing sleeve surface is considerably larger than the amount of the developer conveyed at a projected portion (close to a mirror surface) of the grooves, so that the density non-uniformity resulting from non-uniformity of the developer conveyance amount is liable to occur on the formed image.

Further, particularly due to the durability of the developer in the case where a deterioration of the developer such as spent toner on a carrier or separation of an external additive from the toner proceeds, electric field-dependency of the developing toner during development becomes high. In this case, the recessed portion of the grooves of the developing sleeve surface is, compared with a projected portion of the grooves, large in page between a photosensitive member and the developing sleeve. Therefore, compared with the projected portion, at the recessed portion, an electric field intensity becomes small, so that it becomes difficult to effect development and thus the density non-uniformity is liable to occur.

SUMMARY OF THE INVENTION

A principal object of the present invention is to provide a developing device, including a portion developing sleeves, capable of stabilizing a developer conveying property with time to realize lifetime extension of the developing sleeves and capable of suppressing an occurrence of density non-uniformity.

According to an aspect of the present invention, there is provided a developing device comprising: a plurality of developer carrying members each for carrying at its surface a developer for developing an electrostatic latent image on an image bearing member, wherein of the plurality of developer carrying members, the developer carrying member requiring a largest driving torque resulting from the developer has a surface which has a plurality of grooves extending in parallel in a direction having a component of an axial direction of the developer carrying member at a predetermined interval, and wherein another developer carrying member has a blasted surface.

These and other objects, features and advantages of the present invention will become more apparent upon a consideration of the following description of the preferred embodiments of the present invention taken in conjunction with the accompanying drawings.

Figure 2:
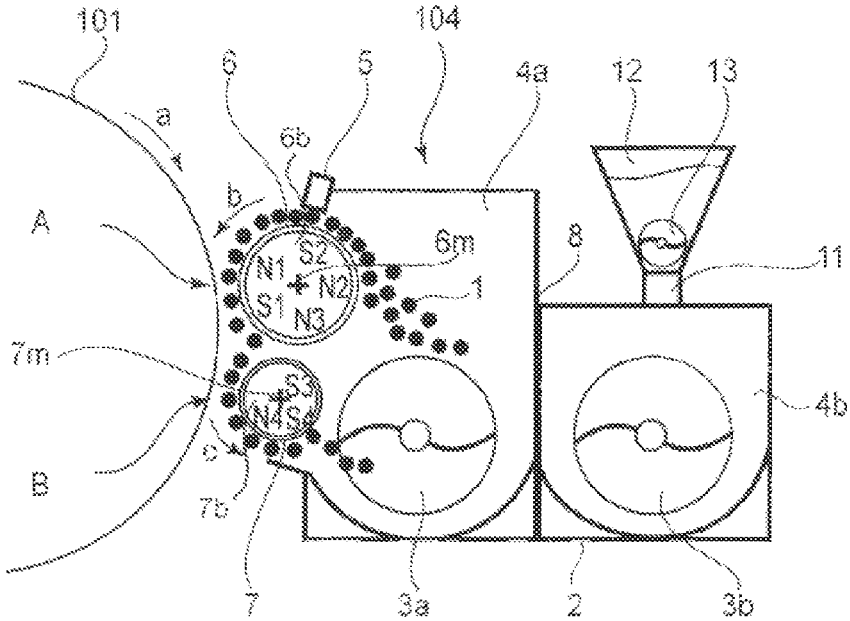
Figure 2:
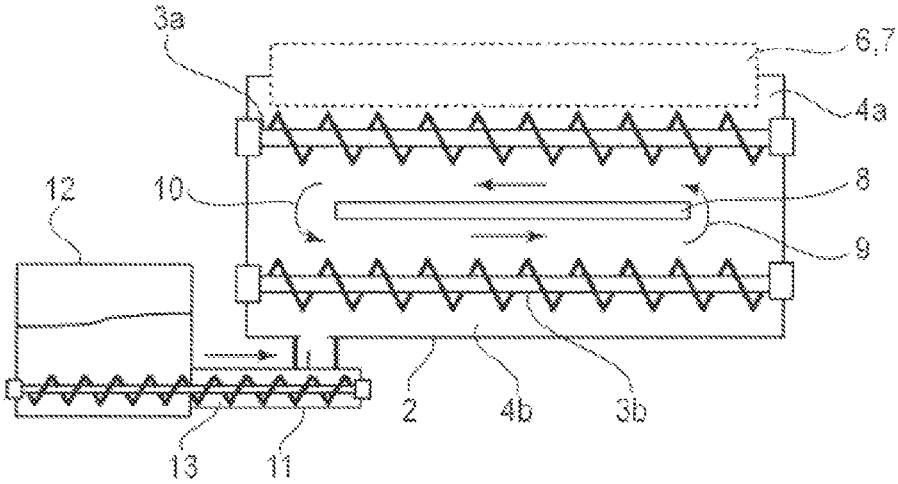

Part (a) of FIG. 2 is an illustration of a developing device according to the First Embodiment, and (b) of FIG. 2 is a sectional view of the developing device in the First Embodiment with respect to a longitudinal direction of the developing device.

Figures 3, 4:
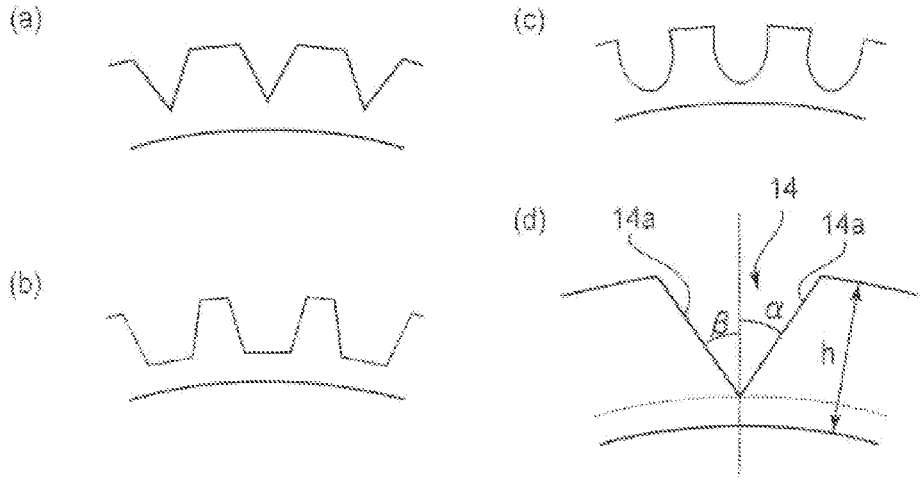

Parts (a) to (d) of FIG. 3 are schematic views each showing a shape of a developing sleeve subjected to grooving process (treatment).

FIG. 4 is a table showing an experiment result in the First Embodiment.

Figures 5, 6:
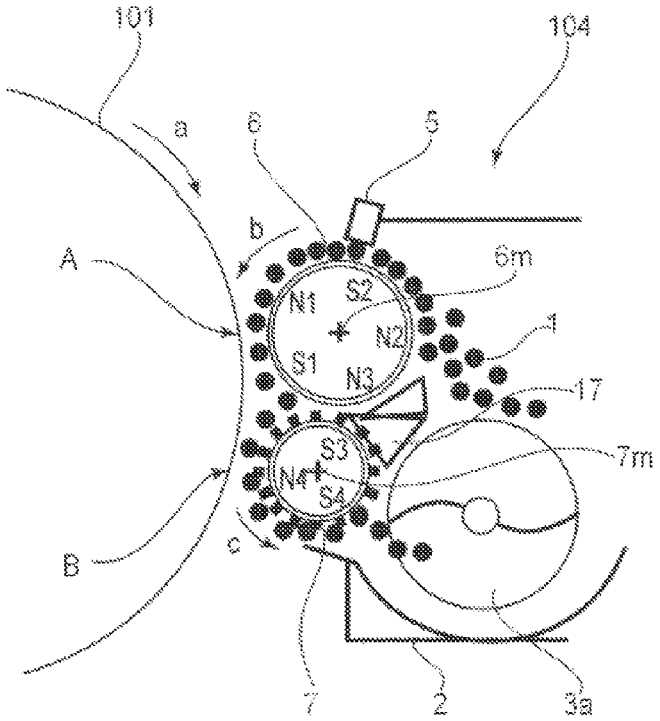

FIG. 5 is an illustration of a developing device in a Second Embodiment.

FIG. 6 is a table showing an experiment result in the Second Embodiment.

DESCRIBED OF THE PREFERRED EMBODIMENTS

First Embodiment

Figure 1:
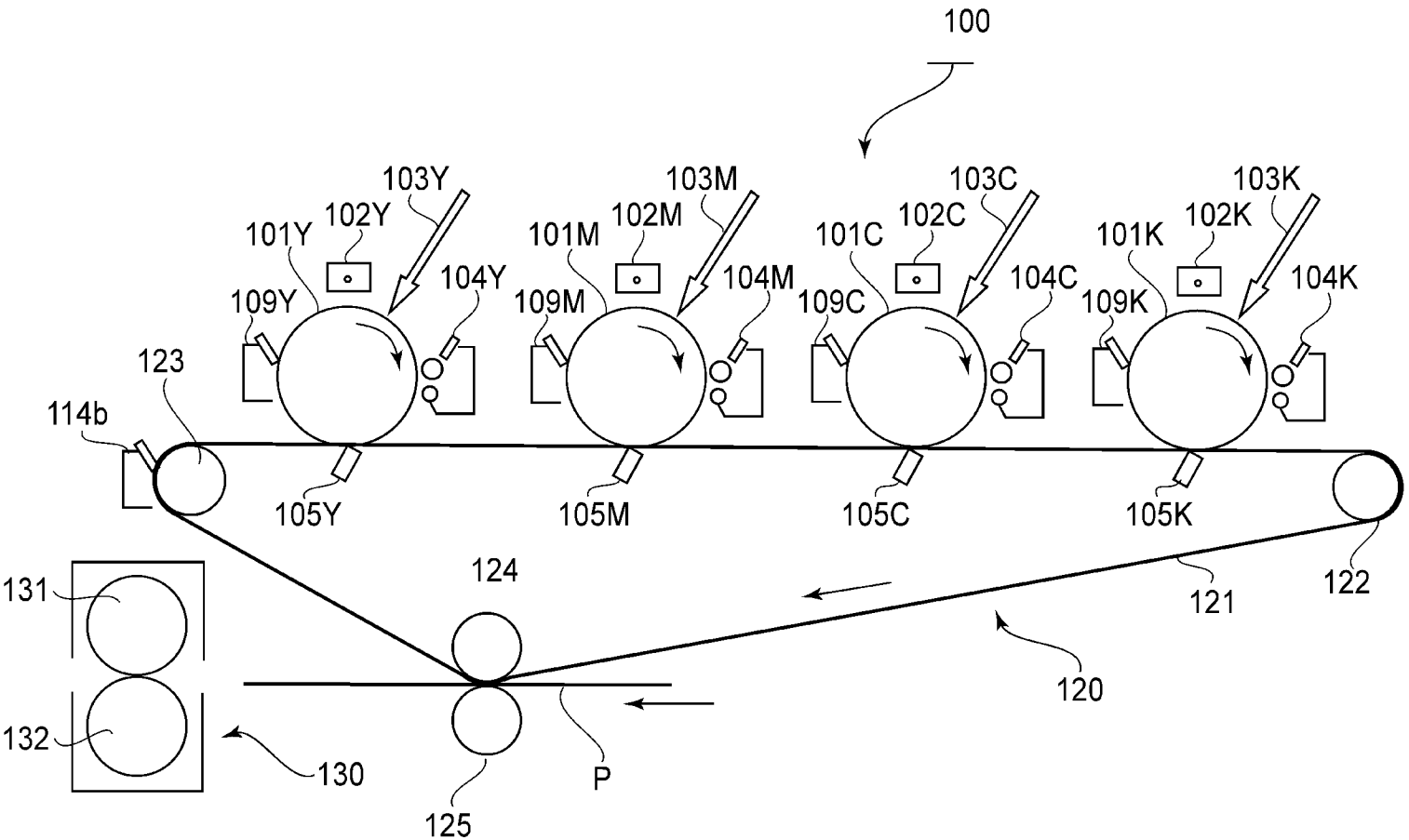
FIG. 1 is an illustration of an image forming apparatus in a First Embodiment.

A developing device according to the present invention and an image forming apparatus in this embodiment will be described with reference to the drawings. FIG. 1 is an illustration of an image forming apparatus in the present invention.

As shown in FIG. 1, the image forming apparatus 100 in this embodiment includes four image forming stations Y, M, C and K and an intermediary transfer device 120. Each image forming station includes a photosensitive drum (latent image bearing member) 101 (101Y, 101M, 101C, 101K). The intermediary transferring device 120 includes an intermediary transfer belt (intermediary transfer member) 121 which is stretched by rollers 122, 123 and 124.

A surface of the photosensitive drum 101 charged by a primary charging device 102 (102Y, 102M, 102C, 102K) is exposed to light by a laser 103 (103Y, 103M<103C, 103K) depending on image information, so that an electrostatic latent image is formed. The electrostatic latent images formed on the image bearing member are developed by developing devices 104 (104Y, 104M, 104C, 104K) as toner images of yellow, magenta, cyan and black, respectively.

The toner images formed by the image forming station are transferred superimposedly onto an intermediary transfer belt 121 by transfer blades (primary transferring means) 105 (105Y, 105M, 105C, 105K) supplied with a transfer bias. The primary-transfer residual toner remaining on the photosensitive drum 101 after the primary transfer is removed by a cleaner 109 (109Y, 109M, 109C, 109K) to be prepared for next image formation.

Four color toner images formed on the intermediary transfer belt 121 are transferred onto a sheet P by a secondary transfer roller (secondary transferring means) 125 provided opposed to a roller 124. The secondary transfer residual toner remaining on the intermediary transfer belt 121 without being transferred onto the sheet P is removed by an intermediary transfer belt cleaner 114*b*. The sheet P on which the toner image is transferred is pressed and heated by a fixing device 130 provided with fixing rollers 131 and 132 and is discharged to the outside of the image forming apparatus 100.

<Developing Device 104>

Part (a) of FIG. 2 is an illustration of the developing device 104 according to this embodiment. Part (b) of FIG. 2 is a longitudinal sectional view of the developing device in this embodiment. As shown in (a) of FIG. 2, the developing device 104 includes a developing container 2 in which a two-component developer 1 containing the toner and a carrier is accommodated. The developing device 104 further includes developing sleeves (developer carrying members) 6 and 7 in the developing container 2, and the two-component developer 1 is conveyed from an upstream developing sleeve 6 to a downstream developing sleeve 7 in a developer conveyance direction (arrow b direction).

As shown in (a) and (b) of FIG. 2, the inside of the developing container 2 is divided, in the horizontal direction, into left and right regions, that is, a developer chamber 4*a* and a stirring chamber 4*b* by a partition wall 8. By first and second feeding screws 3*a* and 3*b* provided in the developing chamber 4*a* and the stirring chamber 4*b*, respectively, the developer 1 is circulated between the developer chamber 4*a* and the stirring chamber 4*b* through openings 9 and 10 at (longitudinal) ends of the partition wall 8.

Incidentally, the developer chamber 4*a* and the stirring chamber 4*b* may also be arranged vertically.

The developing sleeves 6 and 7 are, at an opening corresponding to developing zones A and B in which the developing container 2 opposes the photosensitive drum 101, rotatably provided so as to be partly exposed toward the photosensitive drum 101. Inside the developing sleeves 6 and 7, first and second magnet rollers (magnetic field generating means) 6*m* and 7*m* are provided non-rotatably.

The first magnet roller 6*m* has 5 poles in total consisting of developing magnetic poles S1, N1, N2, N3 and S2. By a developing magnetic field generated by the magnetic pole S1 in the first developing zone A, a magnetic brush of the developer is formed. The magnetic poles N2 and N3 have the same polarity and are adjacent to each other in the developing container 2, so that a barrier against the developer is created. The second magnetic roller 7*m* has 3 poles in total consisting of magnetic poles S3, S4 and N4.

The developing sleeves 6 and 7 rotate in the directions indicated by arrows b and c, respectively, in (a) of FIG. 2 during the developing operation, so that the two-component developer 1, a layer thickness of which is regulated by the chain cutting of the magnetic brush by a regulating blade (chain cutting member) 5, is carried on the developing sleeves 6 and 7. The developing sleeves 6 and 7 carry the layer thickness-regulated developer to the developing zones A and B where they are opposed to the photosensitive drum 101, and supply the developer to the electrostatic latent image formed on the photosensitive drum 101 thereby to develop the electrostatic latent image.

As a specific flow of the developer 1, the developer 1 is fed and flipped up by the first feeding screw 3*a* and is trapped by the N2 pole (scooping pole) of the first developing sleeve 6. With rotation of the developing sleeve 206, the developer is fed in the order of N2 (scooping pole), S2 (cutting pole), N1 (feeding pole), S1 (first developing pole), N3 (relaying pole). Thereafter, the developer 1 on the first developing sleeve moves to the second developing sleeve 7, and the developer 1 is fed on the second developing sleeve 7 in the order of S3 (receiving pole), N4 (second developing pole), S4 (peeling pole). The S4 pole and the S5 pole are the same in the polarity and are adjacent to each other within the developer container 2 to form the barrier against the developer 1, and therefore, the developer 1 is released from the magnetic confining force of the magnetic pole to return to the first feeding screw 3*a* to be fed again.

Among them, at the opposing portion where the second developing sleeve 207 is opposed to the photosensitive drum 101, i.e., in the second developing zone B, the pole N4 is contacted to the photosensitive drum 101, and the second developing operation is effected to the electrostatic latent image which has passed through the first developing zone A. By effecting the second development, a high development efficiency is accomplished.

As described above, by using a constitution in which two developing sleeves are provided, a high development efficiency is assured even when the developing time is shortened with speed-up of the peripheral speed of the photosensitive drum 101, so that the satisfactory image formation can be carried out without causing an occurrence of decrease of the developed image density or density non-uniformity.

The toner in an amount corresponding to a consumption by the image formation is replenished from a hopper 12 into the developing container 2 by passing through a developer replenishing opening 11 by a rotational force of a replenishing screw 13 and the weight of the developer.

In order to improve the developing efficiency, i.e., a degree of impartment of the toner to the electrostatic latent image, a developing bias voltage in the form of a DC voltage biased (superposed) with an AC voltage is applied from a power source (not shown) to the developing sleeves 6 and 7. In this embodiment, the DC voltage of −500 V and the AC voltage of 1800 V in peak-to-peak voltage (Vpp) and 12 kHz in frequency (f) were used. However, the DC voltage value and the AC voltage waveform are not limited thereto.

In general, in a two-component magnetic brush developing method, when the AC voltage is applied, the developing efficiency is increased and thus the image is high in quality but is rather liable to cause fog. For this reason, the fog is prevented by providing a potential difference between the DC voltage applied to the developing sleeves 6 and 7 and a charge potential of the photosensitive member 1 (i.e., a white background portion potential).

In this embodiment, a diameter of the upstream developing sleeve 6 is 24 mm, a diameter of the downstream developing sleeve 7 is 20 mm, the diameter of the photosensitive drum 101 is 80 mm, and a gap between the developing sleeve (6, 7) and the photosensitive drum 101 in the closest region therebetween is about 400 μm. The developing sleeves 6 and 7 are made of a non-magnetic material such as aluminum or stainless steel. The developing sleeves 6 and 7 include a base member 6*b* and 7*b* principally formed of an aluminum alloy, a copper alloy or a metal having a Vickers hardness Hv which satisfies a range of 50-150.

The regulating blade 5 is a plate-like member extending along the longitudinal axis of the developing sleeves 6 and 7. The material for the regulating blade 5 is a non-magnetic material such as aluminum or stainless steel or the like or a magnetic low-carbon steel material such as SPCC or the like, or a composite plate including the non-magnetic material and the magnetic material. The gap between regulating blade 5 and the developing sleeve 6 was set at 200-1000 μm, preferably 300-700 μm. In this embodiment, it was set at 500 μm.

In the developing zones A and B, the peripheral surfaces of the developing sleeves 6 and 7 of the developing apparatus 104 move codirectionally with moving direction of the photosensitive drum 101, wherein a peripheral speed ratio relative to the photosensitive drum 101 is 2.0. The peripheral speed ratio is set at 0-3.0 times, preferably set at any times between 0.5 time and 2.0 times. With increase of the moving speed ratio, the development efficiency increases, but if it is too large, a problem such as toner scattering or developer deterioration may arise, and therefore, it is preferable that the peripheral speed ratio is set in the above ranges.

<Developer 1>

The toner of the two-component developer 1 contains colored particles made up of a binder resin, a coloring agent, colored resin particles containing other additives as desired, and external additives such as fine powder of colloidal silica. Further, the toner is formed of a negatively chargeable polyester resin material and is not less than 4.0 μm and not more than 1.0 μm in volume-average particle size, preferably be not more than 8.0 μm. Further, with respect to the toner in recent years, in order to improve a fixing property, the toner with a low melting point or the toner with a low glass transition point Tg (e.g., Tg≤70° C.) is used in many cases. Further, in order to improve a parting property after the fixing, there is also the case where a wax is contained in the toner.

As the material for the carrier of the two-component developer 1, surface-oxidized or non-oxidized particles of a metallic substance, such as iron, nickel, cobalt, manganese, chrome, rare-earth metal and their alloys, or oxidized ferrite, and the like, can be suitably used. The method for manufacturing these magnetic particles is not particularly limited. Further, the carrier is 20-60 μm, preferably 30-50 μm, in weight-average particle size, and a volume resistivity of the carrier is not less than $10^7$ Ω·cm, preferably not less than $10^8$ Ω·cm. In this embodiment, the carrier which was $10^8$ Ω·cm in volume resistivity was used.

Incidentally, with respect to the toner used in this embodiment, the volume-average particle size was measured with the use of the following apparatus and method. As the measuring apparatus, a Coulter Counter TA-II (mfd. by Beckman Coulter Inc.), an interface (mfd. by Nikkaki-Bios K.K.) for outputting the number and volume average distributions of the developer, and a personal computer ("CX-1", mfd. by Canon K.K.) were used. As an electrolytic aqueous solution, 1% NaCl aqueous solution prepared by using a first class grade sodium chloride was used.

The measuring method is as follows. That is, 0.1 ml of a surfactant, preferably alkyl-benzene sulfonate, was added, as dispersant, into 10-150 ml of above-mentioned electrolytic aqueous solution. Then, 0.5-50 mg of a measurement sample was added to the above mixture. Then, the electrolytic aqueous solution in which the sample was suspended was subjected to dispersion by an ultrasonic dispersing device for about 1-3 minutes. Then, the distribution of the particles which were in a range of 2-40 μm in diameter was obtained with the use of the Coulter Counter TA-II fitted with a 100 μm aperture as an aperture. The volume-average particle size was obtained from the thus obtained volume-average distribution.

Further, the resistivity of the carrier used in this embodiment was measured by using a cell of the sandwich type, which was 4 $cm^2$ in the area (size) of each of its measurement electrodes, and was 0.4 cm in the gap between the electrodes. The resistivity was measured by a method in which the carrier resistivity was obtained from electric current which flowed through a circuit while 1 kg of weight was applied to one of the electrodes and a voltage E (V/cm) was applied between the two electrodes.

<Relationship Between Surface Treatment and Lifetime of Developing Sleeve>

The lifetime of the developing device including the plurality of developing sleeves comes generally when either one of the plurality of developing sleeves loses the function of providing a sufficient developing property. That is, when either one of the plurality of developing sleeves reaches its end of the lifetime, the developing device is regarded as having reached its end of the lifetime, thus being completely exchanged.

Here, the end of the lifetime means in general the time when the developer feeding performance of the developing sleeve is lowered by a change of the surface property of the developing sleeve and the feeding of the developer to the developing zone becomes insufficient and thus image defect such as a lowering of image density or the like occurs. In the developing device in this embodiment, in the case where the weight per unit area of the developer fed on the developing sleeve is not more than 23 mg/$cm^2$, the lowering of image density occurs and therefore this is determined as the end of the lifetime of the developing device.

Here, in order to extend the lifetime of the developing device, it would be considered that the gap between the regulating blade 5 and the developing sleeve 6 is increased at the time of initial setting to increase the weight per unit area of the developer fed on the developing sleeve. However, when the weight per unit area of the developer fed on the developing sleeve is excessively increased, the gap with the photosensitive drum is clogged with the developer, so that the image defect such as carrier deposition or the like can occur. Therefore, with respect to the developer fed on the developing sleeve, an optimum value of the weight per unit area of the developer at the time of the initial setting is present. In this embodiment, the gap between the regulating blade 5 and the developing sleeve 6 is controlled so that the weight per unit area is 30 mg/cm$^2$.

Here, a mechanism for a change with time of the developer feeding property of the developing sleeve will be described. First, in the case where the developing sleeve surface is smooth as in the case of a mirror surface, friction between the developer and the developing sleeve is extremely small and therefore the developer is little fed. For this reason, at the surface of the developing sleeve 6, moderate projections and recesses (unevenness) are provided, by which friction between the developer and the developing sleeve surface is intentionally created to assure a (sufficient) feeding amount of the developer. As for a method for producing the moderate projections and recesses on the surface of the developing sleeve, there are the following two methods (blasting the grooving process) is general.

The blasting is a processing (treatment) method in which, to a bare tube metal extruded under a high temperature, for example, particles such as grinding powder or glass beads having a predetermined particle size distribution are blasted with high pressure under a cold state. The depth of the projections and recesses at the surface is approx. 5-15 μm, and the developer feeding performance increases with increase of the depth.

The grooving process is a processing method in which a bare tube metal extruded under a high temperature, for example, is cold-drawn, and grooves are formed by a die. A configuration of the grooves is ordinarily V, trapezoidal or U shape in cross-section as shown in (a) to (c) of FIG. 3. The depth of the groove is approx. 50-150 μm from the surface of the developing sleeve, and the number of the grooves is ordinarily 50-120 for a sleeve having an outer diameter of 20 mm. The feeding power increases with increase of the depth and with increase of the number of the grooves.

In either of the above two surface processing methods, due to abrasion (wearing) with time by friction with the developer, an end of the projected portion by the blasting is abraded or an edge portion by the grooving process is abraded, so that the feeding property of the developer is lowered. However, the developing sleeve subjected to the grooving process is, compared with the developing sleeve subjected to the blasting, generally small in change of the developer feeding property by the abrasion with time and therefore can achieve the long lifetime.

<Case Where Both of Developing Sleeves 6 and 7 are Subjected to Grooving Process>

Therefore, the developing sleeves 6 and 7 of the developing device 104 where subjected to the grooving process at their surfaces to form a V-shaped groove 14, thus being tried to achieve the long lifetime. The grooves 14 are provided in substantially parallel with respect to axial directions of the developing sleeves 6 and 7 at substantially regular intervals (pitches). Each groove 14 has a shape such that an upstream side-wall 14*a* with respect to a rotational direction of each of the developing sleeves 6 and 7 is formed at an angle α of 45 degrees between itself and the normal direction and on the other hand a downstream side-wall 14*b* with respect to the rotational direction is formed at an angle β of 45 degrees between itself and the normal direction. Further, the groove 14 has a depth h=90 μm. Further, the number of the grooves is 75 lines for the upstream developing sleeve 6 and is 60 lines for the downstream developing sleeve 7.

However, in the above-described example in which both of the developing sleeves 6 and 7 were subjected to the grooving process, there was the case where a pitch non-uniformity with a pitch of about 0.5 mm occurred on the image. This is because the groove pitch of each of the developing sleeves 6 and 7 is about 1.0 mm and the peripheral surfaces of the developing sleeves are rotated with the peripheral speed ratio to the developing device of 2.0 times. As described above, when the surfaces of the developing sleeves 6 and 7 are subjected to the grooving process in the developing device in this embodiment, the long lifetime of the developing sleeves can be achieved but in some cases, the pitch non-uniformity occurred.

<Optimum Combination of Surface Treatments of Developing Sleeves for Realizing Both of Long Lifetime and No Pitch Non-Uniformity>

For that reason, in order to realize an optimum combination of surface treatments of the developing sleeves capable of providing the long lifetime and preventing the occurrence of the pitch non-uniformity, the following experiments were conducted.

First, generally, the projections and recesses are abraded and changed by abrasion with time due to the friction with the developer and therefore a value of a driving torque (static torque) depending on a magnitude of the friction with the developer was noticed.

Specifically, as a preparation for the experiments, the following four developing sleeves 6 and 7 ((1) to (4)) subjected to different surface treatments using the magnetic rollers 6*m* and 7*m* in the developing sleeves 6 and 7 as fixed parameters were prepared.

(1) Developing sleeve 6 subjected to blasting (average surface roughness Rz=13) . . . upstream blasting (2) Developing sleeve 7 subjected to blasting (average surface roughness Rz=13) . . . downstream blasting (3) Developing sleeve 6 subjected to grooving process ((d) of FIG. 3, 75 groove lines)

(4) Developing sleeve 7 subjected to grooving process ((d) of FIG. 3, 60 groove lines)

First, the driving torques of the developing sleeves 6 and 7 with no developer (upstream torque with no developer and downstream torque with no developer) were checked. Next, 600 g of the developer was placed in the developing container and then the gap between the regulating blade 5 and the developing sleeve 6 was adjusted so that the developer amount per unit area on each of the developing sleeves 6 and 7 was 30 mg/cm$^2$. Thereafter, the driving torques in the presence of 600 g of the developer for the developing sleeves 6 and 7 (upstream torque with developer and downstream torque with developer) were measured. Here, each of the upstream torque with developer and the upstream torque with no developer is referred to an upper torque ("UP-TORQUE"), and each of the downstream torque with developer and the downstream torque with no developer is referred to as a lower torque ("LW-TORQUE").

Finally, in the state in which 600 g of the developer was retained in the developing container 2, the developing sleeves 6 and 7 and the first and second feeding screws 3*a* and 3*b* were subjected to normal idling (hereinafter referred to as development idling). Here, the development idling is continued until the surface of the developing sleeve 6 or 7 is abraded so that the developer amount per unit area reaches 23 mg/cm$^2$.

Incidentally, a driving torque measuring method is as follows.

After the image formation, in a normal developer circulation state, gears of the developing device are disconnected to release connection of the developing sleeves and the feeding screws. Thereafter, a torque measuring device is coupled (mounted) on a shaft of each developing sleeve and measured the static torque (torque with developer) at the time of start of the rotation of the sleeve. Then, in a state in which the developer on each sleeve is removed and the developer in the developing container is removed, the torque (torque with no developer) at the time of the sleeve rotation start is similarly measured. From a difference between these torques, the driving torque can be measured (determined). Incidentally, as the torque measuring device, a torque gauge ("ATG6CN", mfd. by TOHNICHI mfg. Co., Ltd.) was used.

Here, by the experiments described above, with respect to combinations of the developing sleeves 6 and 7 ((1) to (4)) described above, parameters including the upper torque and lower torque (unit: N·m), which of the developing sleeves 6 and 7 first reaches 23 mg/cm$^2$ in developer amount per unit area by the development idling, an idling time (until the developer amount per unit area reaches 23 mg/cm$^2$), the presence ("x") or the absence ("o") of the occurrence of the pitch non-uniformity were checked. FIG. 4 shows this experiment result.

As shown in FIG. 4, as in experiment (1) "EXP(1)", in a combination of upstream sleeve blasting ("BLAST") and downstream sleeve blasting, as in a conventional constitution, the upstream developing sleeve reaches its end of the lifetime by the development idling for 250 hours. "250 hours" corresponds to the lifetime of sheet passing of about 1000K (1000×10$^3$) sheets since the image forming apparatus in this embodiment is operated at about 70 ppm (pages per minute).

As in experiment (2) ("EXP(2)"), in a combination of upstream sleeve grooving process ("GROOVE") and downstream grooving process, the lifetime is extended to 750 hours with respect to the development idling but on the other hand, the pitch non-uniformity occurs. As in experiment (3) "EXP (3)"), in a combination of upstream sleeve grooving process and downstream blasting, by the development idling for 500 hours, the downstream developing sleeve reaches its end of the lifetime different from the above experiments. As in experiment (4) ("EXP(4)"), in a combination of upstream blasting and downstream grooving process, substantially similarly as in the result of experiment (1), the upstream developing sleeve reaches its end of the lifetime by the development idling for 250 hours. In either of experiments (1) to (4), the upper torque is 0.7 N·m and the lower torque is 0.4 N·m.

In consideration from these results, in the developing device provided with the plurality of developing sleeves (two developing sleeves in this embodiment), the developing sleeve with the largest driving torque resulting from the developer is most abraded by the developer and is liable to reach an end of its developer feeding property earliest by the abrasion. Therefore, as in experiment (3), the surface treatment of the developing sleeve with the largest driving torque, resulting from the developer, which is a rate-determining factor of the lifetime of the developing sleeve is effected by the grooving process, so that the lifetime extension of the developing sleeve can be realized.

On the other hand, the developing sleeve with the smallest driving torque resulting from the developer is not readily abraded by the friction with the developer, so that the lifetime of the developing sleeve is sufficiently long with respect to the blasting. Further, when the lifetime is intended to be further extended by subjecting also to the developing sleeve with the smallest driving torque resulting from the developer to the grooving process, as in experiment (2), all the plurality of developing sleeves have been subjected to the grooving process, so that the pitch non-uniformity resulting from the groove pitch. Therefore, the developing sleeve with the smallest driving torque resulting from the developer is optimum as the developing device as a whole, when the developing sleeve is kept in the blasting state, from the viewpoints that the developing sleeve does not readily reach its end of the lifetime affected by the abrasion and that the occurrence of the pitch non-uniformity of the groove pitch due to the grooving process is prevented.

Incidentally, in this embodiment, the constitution in which the two developing sleeves are provided is described in this embodiment but, e.g., in a constitution in which three developing sleeves are provided, the grooves are formed at the peripheral surface of the developing sleeve with the largest driving torque resulting from the developer, and other two developing sleeves are subjected to the blasting.

From the above, in the developing device 104 in this embodiment in which the plurality of (two) developing sleeves are provided, of the plurality of developing sleeves, the developing sleeve with the largest driving torque resulting from the developer is subjected to, at its peripheral surface, the treatment (processing) in which the portion grooves at least including a component extending along the axial direction are disposed in parallel at a predetermined interval. Further, the peripheral surface of the developing sleeve(s) other than the developing sleeve (with the largest driving torque) is subjected to the blasting with spherical particles. As a result, it is possible to extend the lifetime of the developing sleeve, with the largest driving torque resulting from the developer, having the shortest lifetime and thus it is possible to achieve the long lifetime of the developing device while preventing the occurrence of the pitch non-uniformity resulting from the groove pitch.

Second Embodiment

A developing device according to the present invention and an image forming apparatus in this embodiment will be described with reference to the drawings. Portions (means) for which the description in the First Embodiment is repeated are represented by the same reference numerals or symbols and will be omitted from the description. FIG. 5 is an illustration of the developing device according to this embodiment. FIG. 6 is a table showing an experiment result in this embodiment.

As shown in FIGS. 5 and 6, the developing device 104 in this embodiment is provided with a carrying-preventing member 17, so that the driving torque of the developing sleeve 7 resulting from the developer is made larger than the driving torque of the developing sleeve 6 resulting from the developer.

The carrying-preventing member 17 is a square bar-like member of the same resin material as that for the developing container and prevents the developer 1 from crossing the barrier created by repelling poles of the magnet rollers 6*m* and 7*m* to be fed on and carried around the peripheral surface of the developing sleeve. Thus, in the case where the carrying-preventing member is provided immediately after the peeling pole in order to prevent the image defect (adverse effect) such as fog, the degree of the friction of the developer in the neighborhood of the peeling pole becomes large. As a result, the driving torque of the developing sleeve 7 resulting from the developer is larger than the driving torque of the developing sleeve 6 resulting from the developer.

Also in this embodiment, similarly as the First Embodiment described above, the measurement of the driving torque and the experiments in which the time until the developing sleeve reaches its end of the lifetime is measured are conducted, and their results are shown in FIG. 6.

As shown in FIG. 6, as in experiment (5) "EXP(5)", in a combination of upstream sleeve blasting ("BLAST") and downstream sleeve blasting, as in a conventional constitution, the upstream developing sleeve reaches its end of the lifetime by the development idling for 250 hours.

As in experiment (6) ("EXP(6)"), in a combination of upstream sleeve grooving process ("GROOVE") and downstream grooving process, the lifetime is extended to 750 hours with respect to the development idling but on the other hand, the pitch non-uniformity occurs. As in experiment (3) "EXP (7)"), in a combination of upstream sleeve grooving process and downstream blasting, substantially similarly as in the result of experiment (5), the downstream developing sleeve reaches its end of the lifetime by the development idling for 250 hours. As in experiment (8) ("EXP(8)"), in a combination of upstream blasting and downstream grooving process, by the development idling for 400 hours, the upstream developing sleeve reaches its end of the lifetime different from the above experiments. In either of experiments (5) to (8), the upper torque is 0.6 N·m and the lower torque is 0.8 N·m.

In consideration from these results, in the developing device provided with the plurality of developing sleeves (two developing sleeves in this embodiment), as well, the developing sleeve with the largest driving torque resulting from the developer, i.e., the downstream developing sleeve is most abraded by the developer and is liable to reach an end of its developer feeding property earliest by the abrasion. Therefore, the surface treatment of the developing sleeve with the largest driving torque, resulting from the developer, which is a rate-determining factor of the lifetime of the developing sleeve is effected by the grooving process, so that the lifetime extension of the developing sleeve can be realized.

On the other hand, the developing sleeve with the smallest driving torque resulting from the developer is not readily abraded by the friction with the developer, so that the lifetime of the developing sleeve is sufficiently long with respect to the blasting. Further, when the lifetime is intended to be further extended by subjecting also to the developing sleeve with the smallest driving torque resulting from the developer to the grooving process, all the plurality of developing sleeves have been subjected to the grooving process, so that the pitch non-uniformity resulting from the groove pitch. Therefore, the developing sleeve with the smallest driving torque resulting from the developer is optimum as the developing device as a whole, when the developing sleeve is kept in the blasting state, from the viewpoints that the developing sleeve does not readily reach its end of the lifetime affected by the abrasion and that the occurrence of the pitch non-uniformity of the groove pitch due to the grooving process is prevented.

From the above, in the developing device 104 in this embodiment in which the plurality of (two) developing sleeves are provided, of the plurality of developing sleeves, the developing sleeve with the largest driving torque resulting from the developer is subjected to, at its peripheral surface, the treatment (processing) in which the portion grooves at least including a component extending along the axial direction are disposed in parallel at a predetermined interval. Further, the peripheral surface of the developing sleeve(s) other than the developing sleeve (with the largest driving torque) is subjected to the blasting with spherical particles. As a result, it is possible to extend the lifetime of the developing sleeve, with the largest driving torque resulting from the developer, having the shortest lifetime and thus it is possible to achieve the long lifetime of the developing device while preventing the occurrence of the pitch non-uniformity resulting from the groove pitch.

Incidentally, in the case where the difference in driving torque between the developing sleeve 6 with the smallest driving torque resulting from the developer and the developing sleeve 7 with the largest driving torque resulting from the developer is 0.2 N·m or more, the developing sleeve 7 with the largest driving torque resulting from the developer is liable to reach its end of the lifetime and therefore the effect of the lifetime extension becomes conspicuous by providing the grooves 14.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 016179/2011 filed Jan. 28, 2011, which is hereby incorporated by reference.

What is claimed is:

1. A developing device comprising:

a developing container unit configured to contain and circulate a developer; and a plurality of developer carrying members each for carrying on its surface the developer for developing an electrostatic latent image on an image bearing member, wherein the developer carrying member providing a largest difference in driving torque measured before and after being coated with a toner on its surface thereof is provided with a plurality of circumferentially spaced grooves, and the remaining developer carrying member has a blast-treated surface.

2. The developing device according to claim 1, wherein the developer carrying member requiring the largest difference in driving torque and the developer carrying member requiring a smallest difference in driving torque provide a difference in torque differentials of 0.2 N·m or more.

3. The developing device according to claim 1, wherein each of the developer carrying members comprises a base member principally formed of an aluminum alloy, a copper alloy or a metal having a Vickers hardness Hv which satisfies a range of 50-150.

* * * * *